United States Patent [19]

Wei

[11] 4,342,346

[45] Aug. 3, 1982

[54] AUTOMATIC POWDERED MILK FILLERS

[76] Inventor: Yung-Kuan Wei, No. 196, Yen Tien Li An Nan District, Tainan, Taiwan

[21] Appl. No.: 131,546

[22] Filed: Mar. 18, 1980

[51] Int. Cl.[3] ..... B65B 1/12

[52] U.S. Cl. ..... 141/85; 141/283

[58] Field of Search ..... 141/85, 82, 284, 250-283, 141/129-191, 369-381, 351-362, 89-92, 1, 11

[56] References Cited

U.S. PATENT DOCUMENTS 615,050 11/1898 Salenius ..... 141/82

*Primary Examiner*—Houston S. Bell, Jr.

*Attorney, Agent, or Firm*—Holman & Stern

[57] ABSTRACT

A powdered milk dispensing device comprises a container for powdered milk having an outlet spout at the bottom through which the powder is fed by a screw conveyor. Bottles are held in place under the spout by a base assembly including an ultra-violet sterilizing lamp and push button switches for energizing the lamp and a small electric motor which drives the screw conveyor.

4 Claims, 8 Drawing Figures

AUTOMATIC POWDERED MILK FILLERS

BACKGROUND OF THE INVENTION

It is a common custom to open the lid of a can containing powdered milk and scoop some powder with a spoon and then put it into a milk bottle, when we want to dissolve powdered milk for feeding a body. Because the lid of can is often opened, the milk is likely to be contaminated. Besides, it may not be easy to put powdered milk in a bottle with a spoon, as the bottle generally has a small mouth and some of the powdered milk may be spilled outside of the bottle. If the spoon is wet, the milk will stick to it. These are quite inconvenient for the user, and not good from the sanitary point of view.

BRIEF SUMMARY OF THE INVENTION

This invention provides an automatic powdered milk dispensing device comprising a transparent container for powdered milk having a screw conveyer in the lower part of the container. This conveyer is rotated by a small motor directly coupled with it. Under the container a hollow column is placed on a round base which has a number of round holes near its fringe for holding transparent cups. A ring-shaped ultra-violet lamp is set inside this case in order to sterilize milk bottles placed in the transparent cups. When it is desired to fill powdered milk in a bottle, the electric button switch is pushed and powdered milk will be fed by the screw conveyer and dropped into the bottle at the outlet of the container.

BRIEF DESCRIPTION OF DRAWINGS

For the purpose that this invention may be clearly understood an embodiment thereof will now be described by way of example with reference to the accompanying drawings in which:-

DESCRIPTION OF THE PREFERRED EMBODIMENT

Figure 2:
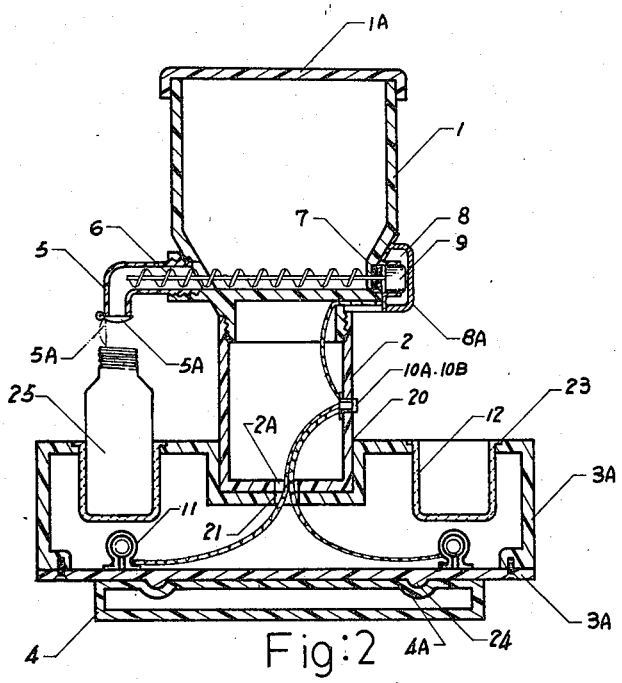
FIG. 2 is a cross sectional view of the device of FIG. 1 taken along a line to show the various parts.
Figure 1:
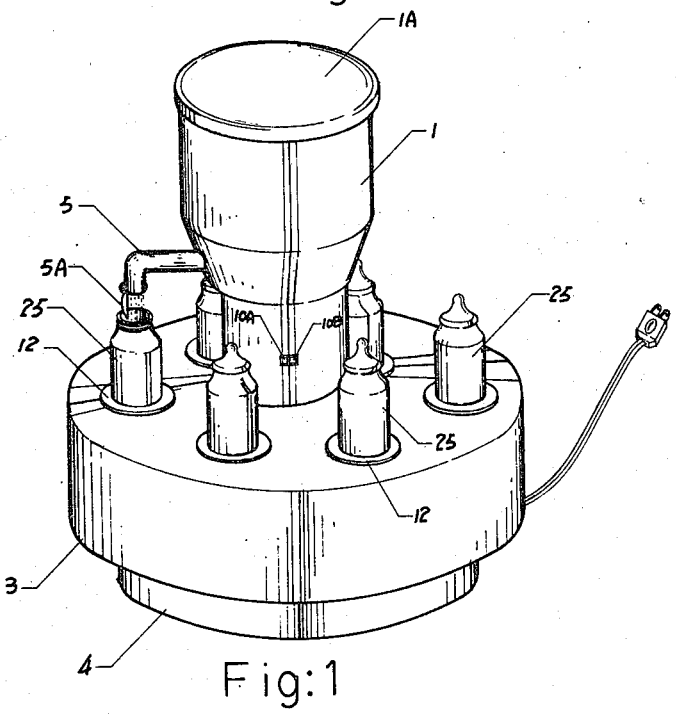
FIG. 1 is a perspective view of the filling device of this invention.
Figure 8:
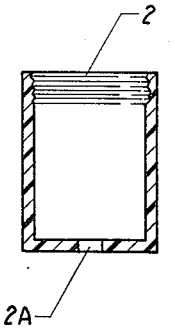
FIG. 8 is a cross sectional view of the column only of this invention.
Figure 7:
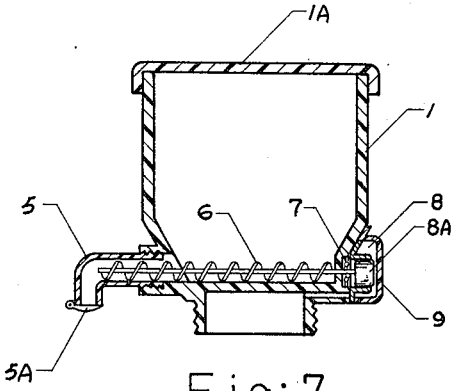
FIG. 7 is a cross sectional view of the container only of this invention.
Figure 3:
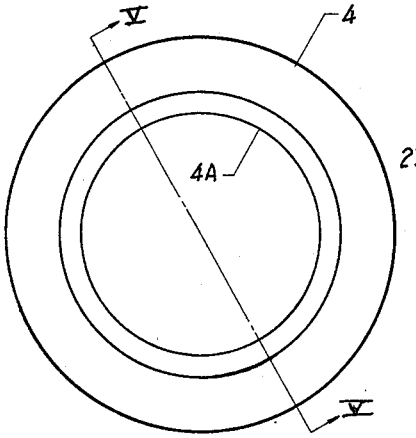
FIG. 3 is a top plan view of the seat.
Figure 4:
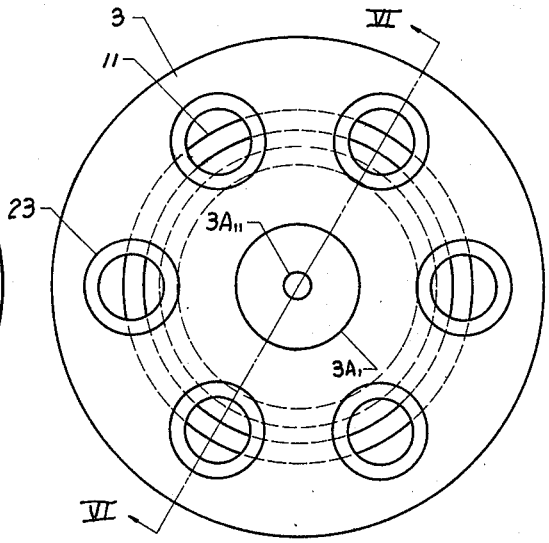
FIG. 4 is a top plan view of the base case.
Figure 5:
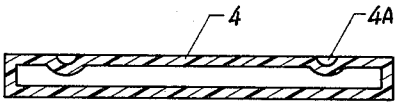
FIG. 5 is sectional cross view of the seat taken along line V—V of FIG. 3.
Figure 6:
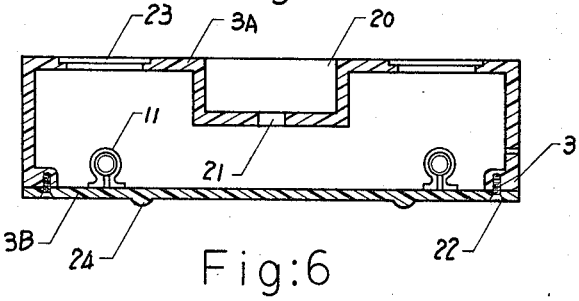
FIG. 6 is sectional cross view of the base case taken along line VI—VI of FIG. 4.

This invention of a powdered milk filler consists of four main parts, namely, a transparent container 1, a column 2, a base case 3 and a seat 4.

The transparent container 1 is round and made of transparent materials, such as glass, non-toxic plastic, etc. The top of the container is open and forms a wide mouth to be capped with a tight lid 1A that can be taken off when powdered milk is to be poured into the container. To the cone-shaped lower part of the container is attached a pipe outlet 5. This outlet 5 has a downward-bent mouth that is equipped with a removable tight cap 5A. Through the mouth powdered milk is dispensed into a milk bottle. The cap 5A is used to cover the mouth for sanitary purpose when this device is not being used.

Inside the container 1 a screw conveyer 6 is provided in the lower part, supported by a ball bearing 7, and extends into a power compartment 8 outside the container 1 wherein it is coupled with a small motor 9. The other end of the conveyor 6 extends into the pipe outlet 5. The amount of the powdered milk being conveyed into the milk bottle is controlled by pushing the electric button switch 10A, mounted in column 2, that starts or stops the motor 9. The power compartment 8 is formed by a cover 8A attached to the side of the container 1, protecting the motor 9, which can be powdered by AC,DC, or both.

The column 2 is made of plastic and the top part of this column is connected with the lowest part of the container 1 by means of screw threads. The bottom of the column 2 fits into circular recess 20 in the top central portion of the base case 3. Two button switches 10A and 10B are mounted in the wall of the column 2, and are used respectively for starting and stoping the motor 9 and an ultra-violet lamp 11. In the bottom center of the column 2 is a hole 2A, which is situated in alignment with the hole 21 in the center of the recess 20 so that the wires connecting the button switch 10B and the ultra-violet lamp 11 can pass through.

The base case 3 made of plastic consists of the upper dish shaped cover 3A and the bottom 3B fastened together such as by screws 22. In the center of the upper cover 3A is recess 20 for the column 2 to set in as previously described. A number of round holes 23 are arranged in circumferential spaced relationship in the top surface of the base case 3 for receiving the transparent cups 12. On the inside of 3B is mounted a ring-shaped ultra-violet lamp 11 on the outside of the bottom 3B there is a ring-shaped ridge 24, which fits the ring-shaped slot 4A of the seat 4.

The seat 4 made of molded plastic has ring-shaped slot 4A on its upper surface for receiving the ring-shaped ridge 24. This design will make the transparent container 1 with the column 2 and the base case 3 sit steadily on the seat 4, and yet be readily disassembly so that it can be moved around freely.

The operation of this filler is quite simple and easy. First powdered milk from a can is poured into the container 1 and its lid 1A is fastened on the mouth. Milk bottles 25 are placed in the transparent cups 12. Next, the ultra-violet lamp 11 is turned on by button 10B sterilizing the bottles. Then cap 5A is removed and the botton switch 10A is pushed to start meter 9 which turns conveyer 6 to feed powdered milk out of the outlet 5 so that the powdered milk may be dropped into a bottle 25 placed in position. When the bottle is properly filled with the powdered milk, the button switch 10A is turned off. The cap 5A is then put on.

This filler device can be used not only for powdered milk but also for coffee, cocoa, and other similar powdered materials.

What is claimed is:

1. An automatic powdered milk dispenser comprising a generally cylindrical hollow container having a funnel shaped portion near its lower end, said lower end being closed and the upper end being open, a removable cap for closing said upper end, a pipe-shaped outlet extending substantially horizontally from the lower part of said funnel shaped portion, a downturned outer end on said outlet, the inner end of said outlet communicating with the interior of said funnel shaped portion, feed means situated within the lower end of said funnel shaped portion to feed powdered milk within said container through said outlet, a cylindrical extension at the lower end of said container having an external screw thread thereon, a hollow upstanding cylindrical column for supporting said container, an internal screw thread at the upper end of said column engaging said external screw thread, the lower end of said column being closed, a hollow cylindrical base for supporting said column comprising an inverted dish-shaped upper member and a plate-like lower member, said lower member closing the lower open end of said upper member and being fastened thereto by screws, a cylindrical recess in the center of said upper member for receiving and removably retaining the lower end of said column in upstanding position, a plurality of holes arranged in circumferential spaced relationship in said upper member around said recess, a cup shaped member disposed within each said hole to receive and hold a bottle therein in upstanding position, said holes being located so that at any one time the upper end of one of said bottles is positioned under said downturned outer end of said outlet to receive powdered milk dispensed therefrom, an ultraviolet lamp within said base for sterilizing said bottles when placed in said cup members, means to operate said feed means, and means to energize said ultraviolet lamp.

2. The dispenser as claimed in claim 1 wherein said feed means comprises a screw conveyor extending substantially horizontally into said pipe-shaped outlet at one end and having a drive shaft extension on the other end, said drive shaft extension extending through said funnel shaped portion to the outlet of said container, an electric drive motor supported on said container and coupled to the outer end of said drive shaft extension to rotate said screw conveyor, a cover member attached to said container to enclose said motor, a first push-button switch mounted on said column and electrically connected to said motor and a source of electric power to start and stop said motor, and said means to energize said lamp comprises a second push-button switch mounted on said column and electrically connected to said lamp and a sorce of electric power to switch said lamp on and off.

3. A dispenser as claimed in claim 2 and further comprising a ball bearing mounted on said container adjacent said motor and operatively engaging said drive shaft extension to support the same, a removable cap on said outer end of said pipe-shaped outlet, and a seat for supporting said dispenser comprising a hollow disc shaped member engaging the lower outer face of said lower member of said base, an annular groove in the upper surface of said seat, and an annular rib on said lower face of said lower member cooperatively engaging said annular groove to prevent lateral relative displacement between said base and said seat.

4. The dispenser as claimed in claim 3 and further comprising aligned holes provided through the lower end of said column and said recess, and said push-button switches are mounted within the upstanding wall of said column so that the electrical connections thereof are inside said column, said electrical connections between said motor and lamp and respective first and second switches being totally concealed within said dispenser, said connections between said second switch and said lamp passing through said aligned holes.

* * * * *